US007748242B2

(12) United States Patent
Saito et al.

(10) Patent No.: US 7,748,242 B2
(45) Date of Patent: Jul. 6, 2010

(54) DRUM TYPE WASHING MACHINE

(75) Inventors: Tatsuya Saito, Nagoya (JP); Yoshikazu Munemoto, Tajimi (JP); Koichi Hosomi, Kasugai (JP)

(73) Assignees: Kabushiki Kaisha Toshiba, Tokyo (JP); Toshiba HA Products Co., Ltd., Osaka (JP); Toshiba Consumer Marketing Corporation, Tokyo (JP)

( * ) Notice: Subject to any disclaimer, the term of this patent is extended or adjusted under 35 U.S.C. 154(b) by 766 days.

(21) Appl. No.: 11/355,153

(22) Filed: Feb. 16, 2006

(65) Prior Publication Data

US 2006/0179897 A1 Aug. 17, 2006

(30) Foreign Application Priority Data

Feb. 17, 2005 (JP) ..... 2005-040872

(51) Int. Cl.
*D06F 37/02* (2006.01)
*D06F 37/30* (2006.01)
*D06F 35/00* (2006.01)

(52) U.S. Cl. ..... 68/23 R; 68/140; 68/142

(58) Field of Classification Search ..... 68/23 R, 68/139, 140, 142
See application file for complete search history.

(56) References Cited

U.S. PATENT DOCUMENTS

| | | | | |
|---|---|---|---|---|
| 5,746,070 | A * | 5/1998 | Bailey et al. | 68/24 |
| 6,148,647 | A * | 11/2000 | Kabeya et al. | 68/140 |
| 6,918,271 | B2 * | 7/2005 | Lim et al. | 68/23.2 |
| 2005/0103060 | A1 * | 5/2005 | Ozturk et al. | 68/3 R |
| 2005/0229651 | A1 * | 10/2005 | Ahn | 68/139 |
| 2005/0252252 | A1 | 11/2005 | Lee et al. | |

FOREIGN PATENT DOCUMENTS

| | | |
|---|---|---|
| CN | 1508323 | 6/2004 |
| CN | 1898431 | 1/2007 |
| JP | 10-328478 | 12/1998 |
| JP | 11-137891 | 5/1999 |
| JP | 11-207077 | 8/1999 |
| JP | 2000-325692 | 11/2000 |
| WO | WO 2005/111295 | 11/2005 |

OTHER PUBLICATIONS

English Language Translation of Chinese Office Action issued Aug. 22, 2008 in corresponding Chinese Application 200610009096.3.

English Translation of Office Action issued in Taiwanese Appl 95104606 on Oct. 21, 2009.

(Continued)

*Primary Examiner*—Joseph L Perrin
(74) *Attorney, Agent, or Firm*—DLA Piper LLP US

(57) ABSTRACT

A drum type washing machine includes a water tub, a drum mounted in the water tub so as to be rotatable a wash operation and a dehydration operation are carried out, the drum including an end plate, a drum support provided on the end plate of the drum and including a mount portion on which a shaft supporting the drum is mounted thereon, and a cover covering the mount portion of the drum support so that the mount portion is rendered substantially planar.

3 Claims, 11 Drawing Sheets

OTHER PUBLICATIONS

English Translation of Office Action issued in Japanese Appl 2005-040872 on Nov. 24, 2009.

English Language Abstract of JP 2000-325692 published Nov. 28, 2000.

English Language Translation of JP 2000-325692 published Nov. 28, 2000.

English Language Abstract of JP 10-328478 published Dec. 15, 1998.

English Language Translation of JP 10-328478 published Dec. 15, 1998.

English Language Abstract of JP 11-137891 published Jun. 25, 1999.

English Language Translation of JP 11-137891 published Jun. 25, 1999.

English Abstract of JP 11-207077 published Aug. 8, 1999.

* cited by examiner

DRUM TYPE WASHING MACHINE

CROSS-REFERENCE TO RELATED APPLICATIONS

This application is based upon and claims the benefit of priority from the prior Japanese Patent Application No. 2005-40872, filed on Feb. 17, 2005, the entire contents of which are incorporated herein by reference.

BACKGROUND OF THE INVENTION

1. Field of the Invention

The present invention relates to a drum type washing machine comprising a water tub and a drum mounted in the water tub for carrying out wash and dehydration operations.

2. Description of the Related Art

Conventional drum type washing machines include a water tub and a cylindrical drum mounted in the water tub. The drum is rotated about an axis so that laundry put therein is agitated in a wash step. Furthermore, the drum is rotated at higher speeds or spun so that laundry is dehydrated by centrifugal force.

FIG. 13 illustrates one of the conventional drum type washing machines of the above-described type. FIG. 13 shows an end plate 101*a* of a drum 101 as viewed at outside. A drum support 102 die-cast from aluminum is mounted on the end plate 101*a*. A shaft 103 is connected with a central part of the drum support 102 for rotating and supporting the drum 101. Reinforcement ribs (rugged contour) 102*a* are formed on an outer surface of the drum support 102.

JP-A-11-207077 discloses a drum type washing machine in which a drum support is provided on an end plate of a drum.

In the above-described conventional construction, stepped portions are formed on the end plate 101*a* of the drum 101 since the drum support 102 is mounted on the end plate 101*a*. Furthermore, since the ribs 102*a* are formed on the drum support 102, the ribs and the stepped portions are resistive against rotation of the drum when the drum 101 is rotated at high speeds or spun. As a result, the ribs and the stepped portions cause wind, producing loud noise. Additionally, power consumption is large since the ribs and the stepped portions are resistive against rotation of the drum.

SUMMARY OF THE INVENTION

Therefore, an object of the present invention is to provide a drum type washing machine in which reduction in noise and power consumption can be achieved by decreasing an amount of resistance against rotation of the drum.

The present invention provides a drum type washing machine including a water tub, a drum mounted in the water tub so as to be rotatable a wash operation and a dehydration operation are carried out, the drum including an end plate, a drum support provided on the end plate of the drum and including a mount portion on which a shaft supporting the drum is mounted thereon, and a cover covering the mount portion of the drum support so that the mount portion is rendered substantially planar.

The invention also provides another drum type washing machine comprising a water tub, a drum mounted in the water tub so as to be rotatable so that a wash operation and a dehydration operation are carried out, the drum including an end plate having recess with a bottom, and a drum support enclosed in the recess of the end plate of the drum and including a mount portion on which a shaft supporting the drum is mounted, wherein the drum support has a first side facing the bottom of the recess and provided with a reinforcing corrugated portion, wherein the drum support has a second side opposed to the first side and substantially planar, the second side and an outer surface of the end plate being substantially coplanar, and wherein the recess has an open end and the drum support includes a portion having such a shape as to cover the open end of the recess.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
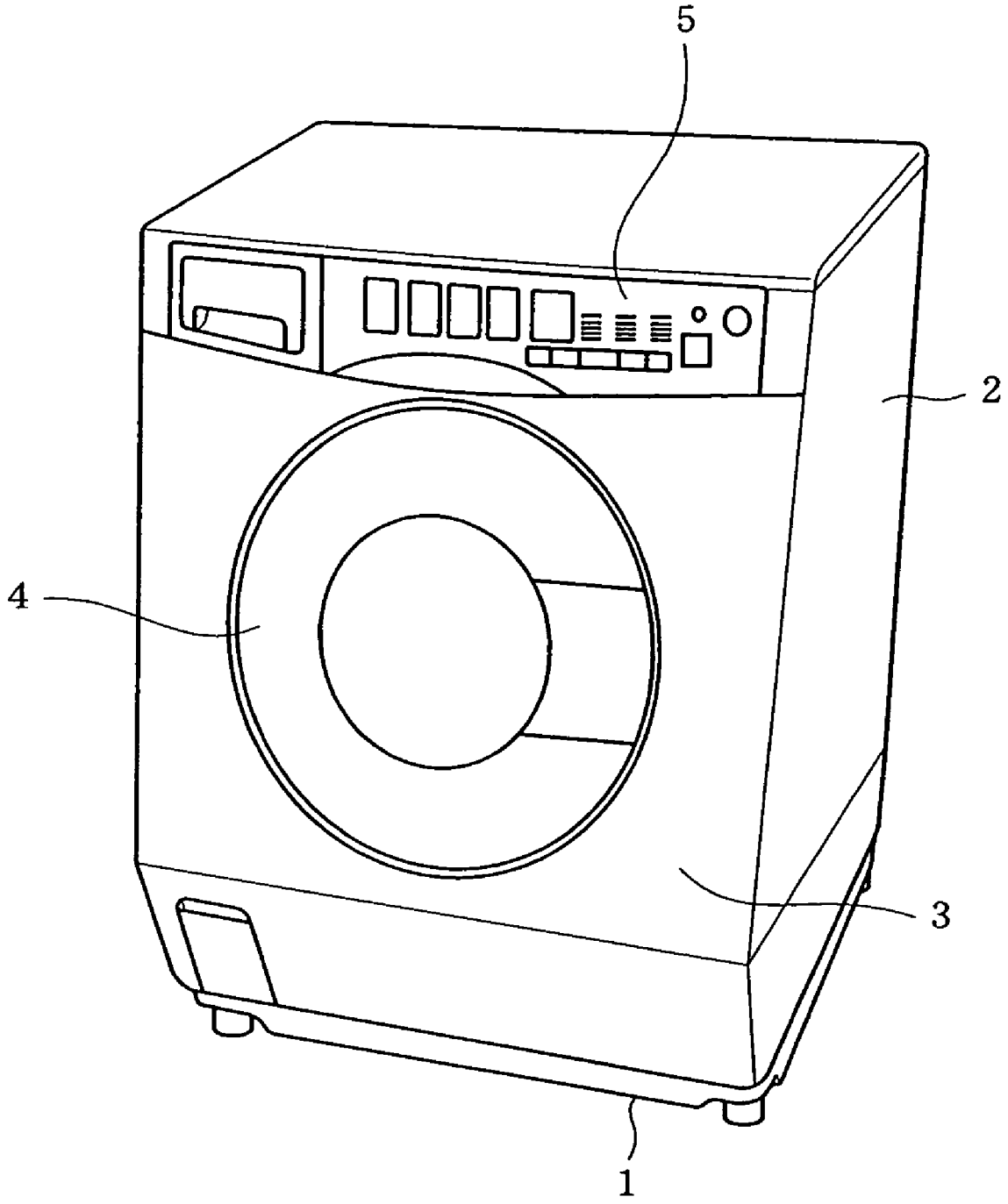
FIG. 1 is a perspective view of a drum type washer-drier in accordance with one form of the disclosure.

Several embodiments of the present invention will be described. FIGS. 1 to 5B illustrate a first embodiment in accordance with the invention. Referring to FIG. 1, an overall construction of a drum type washer-drier of the first embodiment is shown. The drum type washer-drier includes a base 1 made of a resin. A generally rectangular outer cabinet 2 is mounted on the base 1. The cabinet 2 includes a front cover 3 having a centrally formed access opening 3*a* (see FIG. 2) through which laundry is put into and taken out of a drum. A door 4 is mounted on the front cover 3 so as to open and close the opening 3*a*.

An operation panel 5 is mounted on the front cover 3 so as to be located above the door 4. The operation panel 5 is provided with various switches for selecting or setting an operation course or the like. A wash operation, a dehydration operation or a wash-dehydration operation in which the wash and dehydration operations are continuously carried out can be selected on the operation panel.

Figure 2:
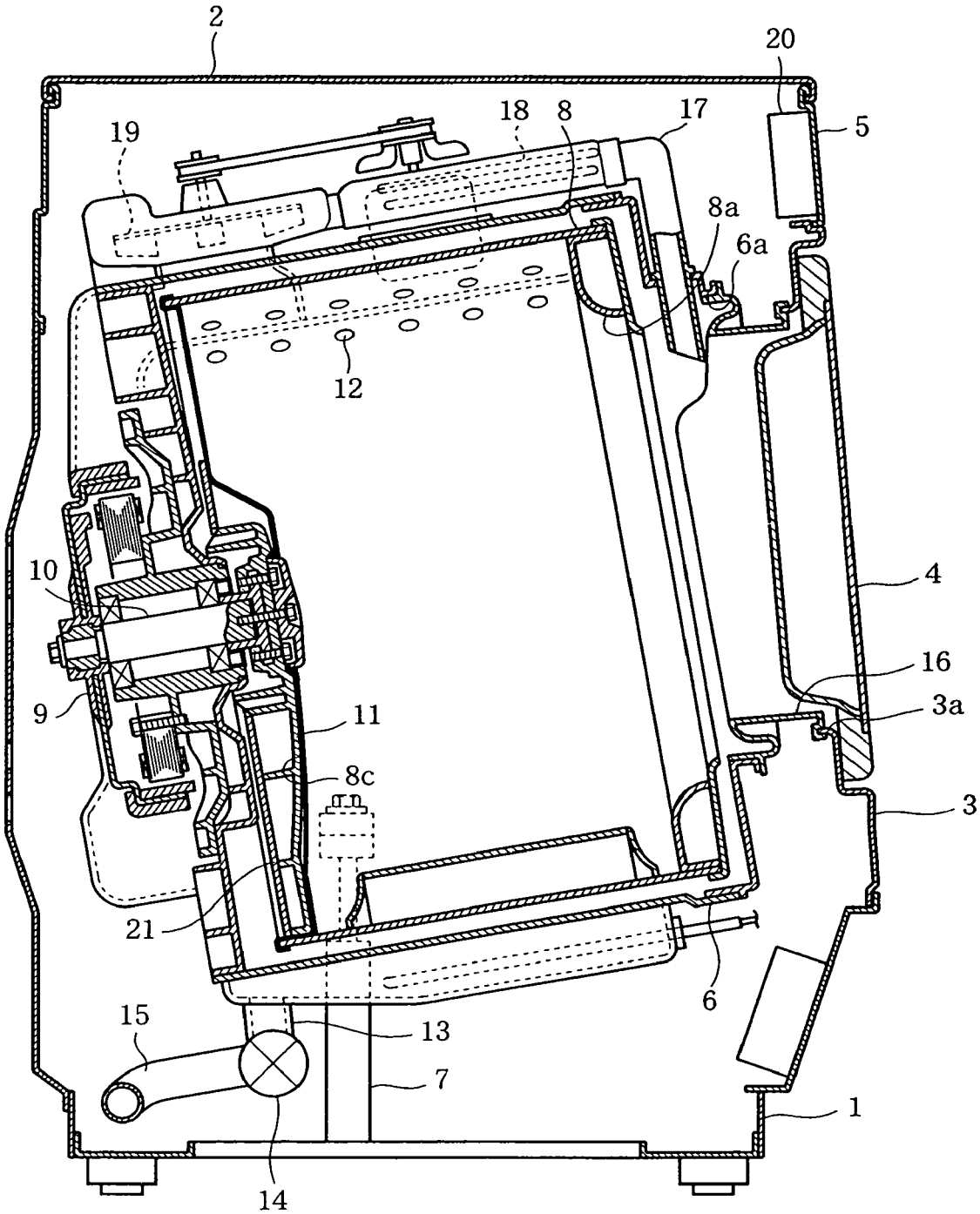
FIG. 2 is a longitudinal section of the drum type washer-drier.

Referring now to FIG. 2, a cylindrical water tub 6 is supported by suspension mechanisms 7 (only one shown) which are further mounted on the base 1. Each suspension mechanism 7 includes a coil spring and a damper. Thus, the water tub 6 is mounted on the base 1 in the cabinet 2. A drum 8 made of stainless steel (SUS403, for example) is mounted in the water tub 6. The water tub 6 and the drum 8 serve as a wash tub in combination. Each of the water tub 6 and the drum 8 is disposed so that a central axis thereof is inclined rearwardly downward.

A brushless DC motor 9 of the outer rotor type is fixed to a rear end of the water tub 6. The motor 9 includes a shaft 10 which extends through an end face of the water tub 6 into an interior of the water tub 6. The shaft 10 has a distal end connected to a drum support 11 mounted on an end plate 8*b* of the drum 8. Upon rotation of a rotor of the motor 9, the shaft 10 is rotated together with the rotor, whereby the drum 8 is rotated.

The drum 8 includes a peripheral wall and the end plate 8*b* both formed with a number of holes 12 serving both as air vents and as water vents. Some of the holes 12 are shown in FIG. 2. Furthermore, a drain hole (not shown) is formed through the lower rear (lowermost portion) of the water tub 6. A drain pipe 13 is connected to the drain hole. A lower end of the drain pipe 13 is connected via a drain valve 14 to another drain pipe 15. The water tub 6 and drum 8 have front ends formed with openings 6*a* and 8*a* respectively. The openings 6*a* and 8*a* communicate via bellows 16 with the opening 3*a* of the front cover 3.

A ventilation duct 17 is provided over the top of the water tub 6 so as to face the interior of the water tub. The ventilation duct 17 is provided with a heater 18. A blowing fan 19 is provided at an upstream side with respect to the ventilation duct 17. The blowing fan 19 supplies air flow into the water tub 6. A further upstream side of the ventilation duct 17 is connected to the water tub 6 so as to face the interior of the water tub. Furthermore, a heat pump including a condenser and an evaporator is also provided though not shown. Accordingly, upon operation of the heater 18 and blowing fan 19, air in the water tub 6 and drum 8 is adapted to be circulated and dehumidified upon operation of the heater 18 and blowing fan 19. Additionally, a control device 20 is provided inside the operation panel in the interior of the cabinet 2. The control device 20 controls an overall operation of the washer-drier.

A user operates switches on the operation panel 5 so that an operation course is set in the washer-drier constructed as described above. When start of operation is instructed, a washing operation or a drying operation is carried out according to a set operation course or a washing-drying operation is carried out so that washing and drying operations are continuously carried out. For example, when the washing-drying operation has been started, a wash step, a dehydration step and a drying step are sequentially carried out.

Figure 3:
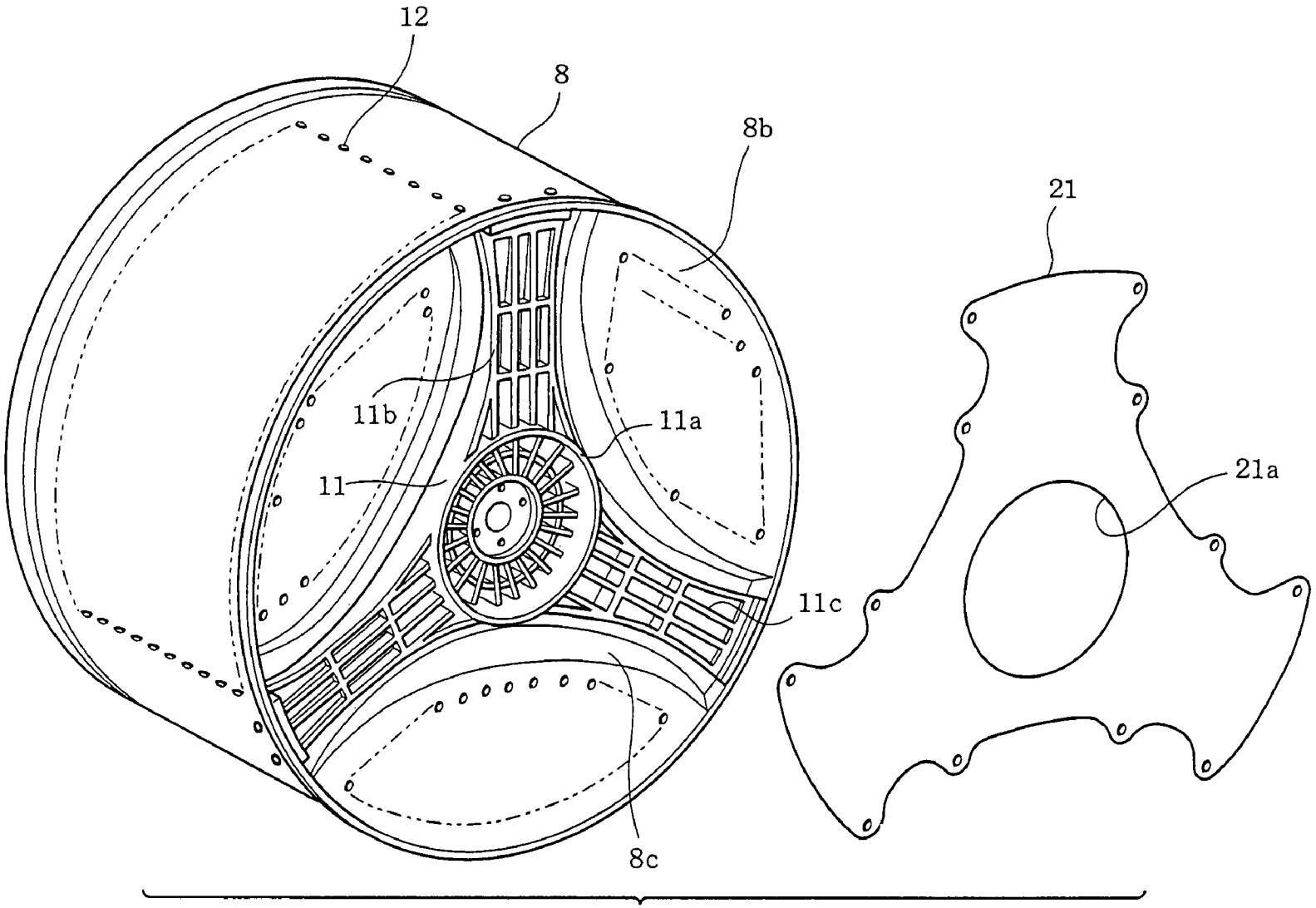
FIG. 3 is a perspective view of a drum with a flow regulator cover being detached.

A concrete construction of the mounting portion of the drum support 11 on the drum 8 will now be described with reference to FIGS. 3 and 4. FIG. 3 shows the drum support 11 mounted on the drum 8. The drum support 11 includes a central portion 11*a* and three protrusions 11*b* extending radially from the central portion 11*a* at regular intervals. The drum support 11 is die-cast from aluminum. The drum support 11 has an outer surface or a side opposite the end plate 8*b* of the drum 8. A number of ribs 11*c* protrude from the outer surface of the drum support 11 configured as shown in FIG. 3. The ribs 11*c* constitute a reinforcing corrugated portion of the drum support 11.

The end plate 8*b* of the drum 8 has a recess 8*c* which the drum support 11 is to be accommodated. The recess 8*c* is formed so as to be swollen inside the drum 8. In this case, the drum support 11 is accommodated in the recess 8*c* and thereafter, distal ends of the respective protrusions 11*b* of the drum support 11 are screwed onto the peripheral wall of the drum 8. Furthermore, the drum support 11 is fixed to the drum 8 by crimping.

Figure 4:
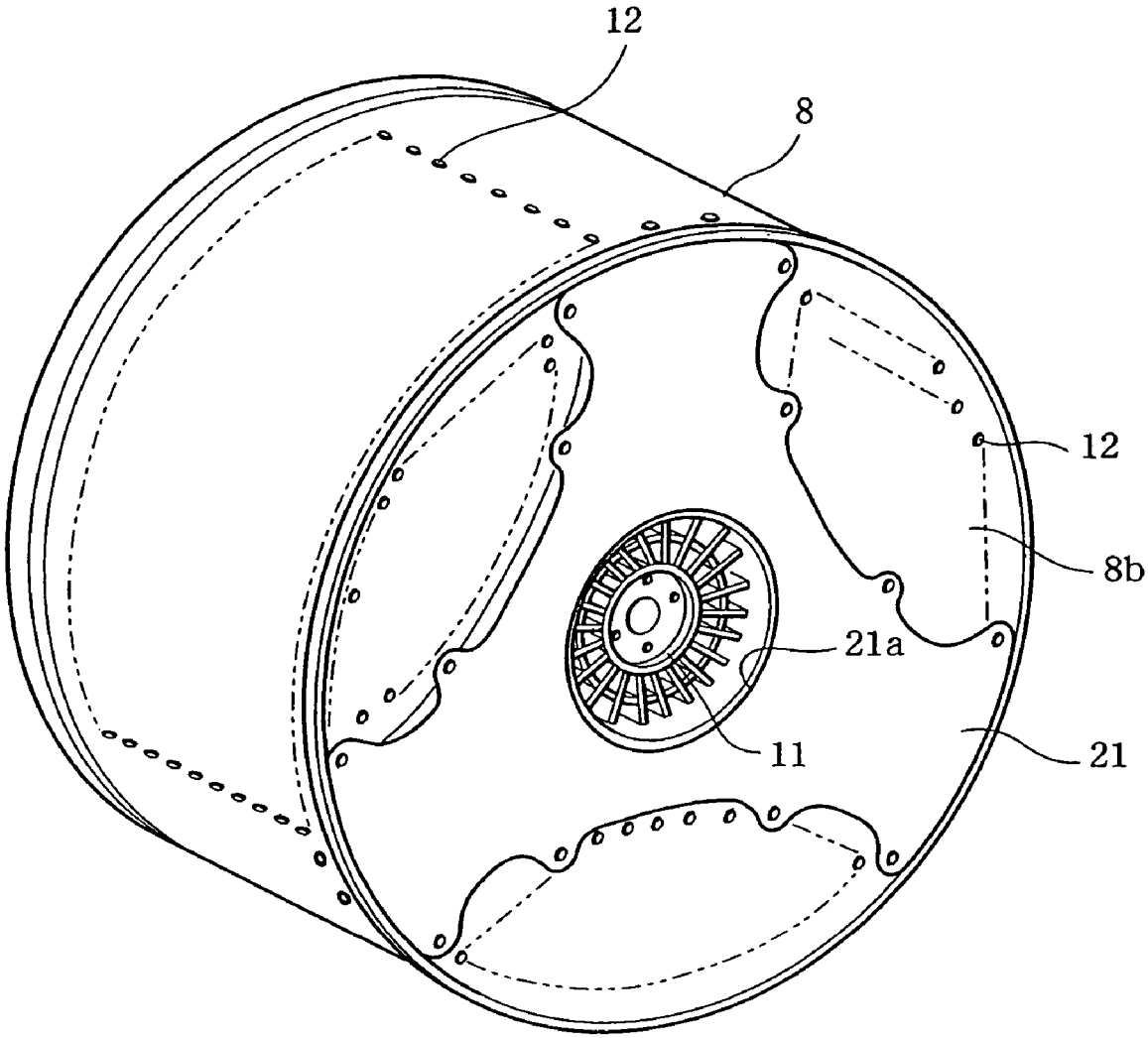
FIG. 4 is a perspective view of the drum with the flow regulator cover being attached.

Referring now to FIG. 4, a rectifying cover 21 is mounted on the end plate 8*b* of the drum 8 so as to close the recess 8*c* and so as to cover the drum support 11. The rectifying cover 21 is made of stainless steel (SUS403) which is the same material as the drum 8. The rectifying cover 21 is formed so as to be larger than the recess 8*c*. The rectifying cover 21 has a centrally located through hole 21*a* through which the shaft 10 and the like are to be inserted (see FIG. 3).

The end plate 8*b* of the drum 8 and the rectifying cover 21 are adapted to be substantially co-planar when the rectifying cover 21 is mounted on the end plate 8*b*. The rectifying cover 21 is screwed on the end plate 8*b* by making using of some of the holes 12 formed through the end plate.

The drum support 11 is accommodated in the recess 8*c* of the drum 8 to be fixed therein. The recess 8*c* is then mounted on the end plate 8*b* so as to close the recess 8*c* and cover the drum support 11. As a result, since an outer surface of the end plate 8*b* is substantially flat, rotational resistance and accordingly noise can be reduced when the drum 8 is rotated at high speeds (1400 rpm, for example) in the dehydration step. Furthermore, power consumption of the washer-drier can also be reduced as the result of reduction in the rotational resistance.

Figure 5A:
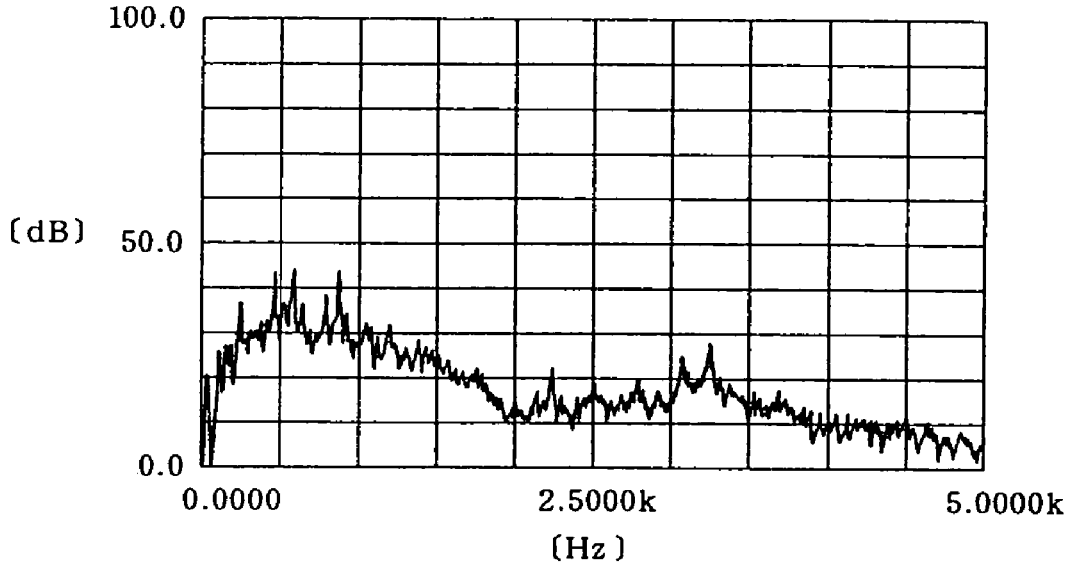
FIGS. 5A and 5B are graphs showing results of noise measurement executed before and after attachment of the flow regulator cover respectively.
Figure 5B:
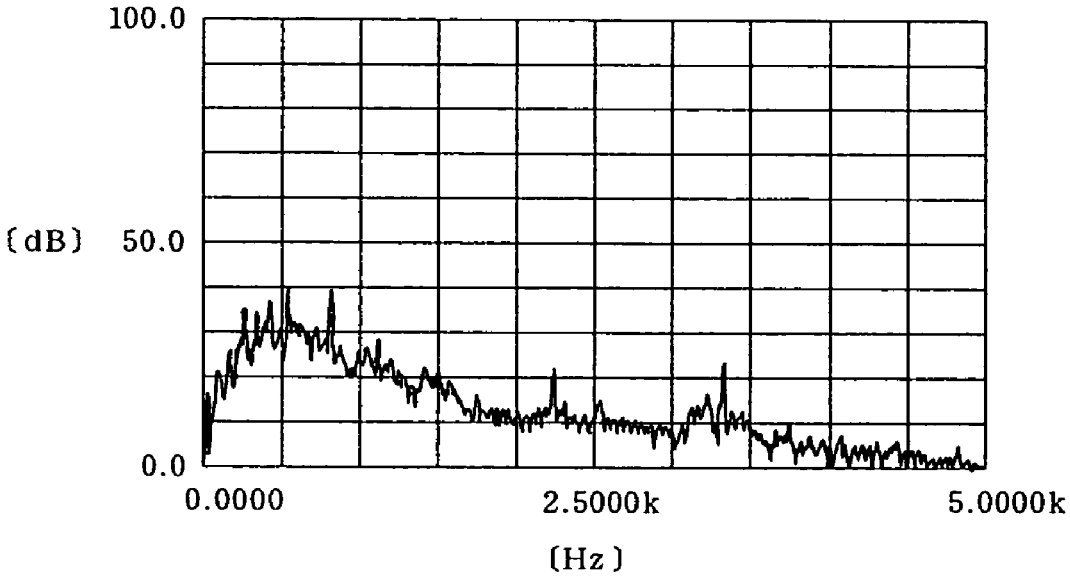

FIGS. 5A and 5B show the results of measurement of noise regarding the washer-drier of the embodiment. More specifically, FIGS. 5A and 5B show the results of fast Fourier transform (FFT) analysis carried out with respect to noise produced from dehydration operation of the drum type washer-drier of the embodiment. FIG. 5A shows the results of measurement with respect to the construction before attachment of the rectifying cover 21, whereas FIG. 5B shows the results of measurement with respect to the construction after attachment of the rectifying cover 21. The axis of abscissas represents frequency in Hz and the axis of ordinates represents sound pressure level in dB in FIGS. 5A and 5B.

In comparison of FIGS. 5A and 5B, it can be considered that the sound pressure level is sufficiently reduced in a frequency band ranging from about 2 kHz to about 5 kHz when the rectifying cover 21 is attached to the drum 8. It is noted that the aforesaid frequency band corresponds to the noise produced by the frequency band (the frequency band of not more than about 2 kHz corresponds to noise produced by the motor).

Furthermore, since the rectifying cover 21 and the drum 8 are made of the same material, that is, stainless steel (SUS403), crevice corrosion can be restrained in the washer-drier of the embodiment as compared with the construction in which the rectifying cover and the drum are made of different materials. Additionally, the drum support 11 includes the central portion 11*a* and the three protrusions 11*b* extending radially from the central portion 11*a* at regular intervals. Since the rectifying cover is formed so as to correspond to the shape of the drum support 11, an amount of material for the rectifying cover 21 can be reduced in the embodiment as compared with the case where an entire end plate 8*b* is covered with a rectifying cover.

Figure 6:
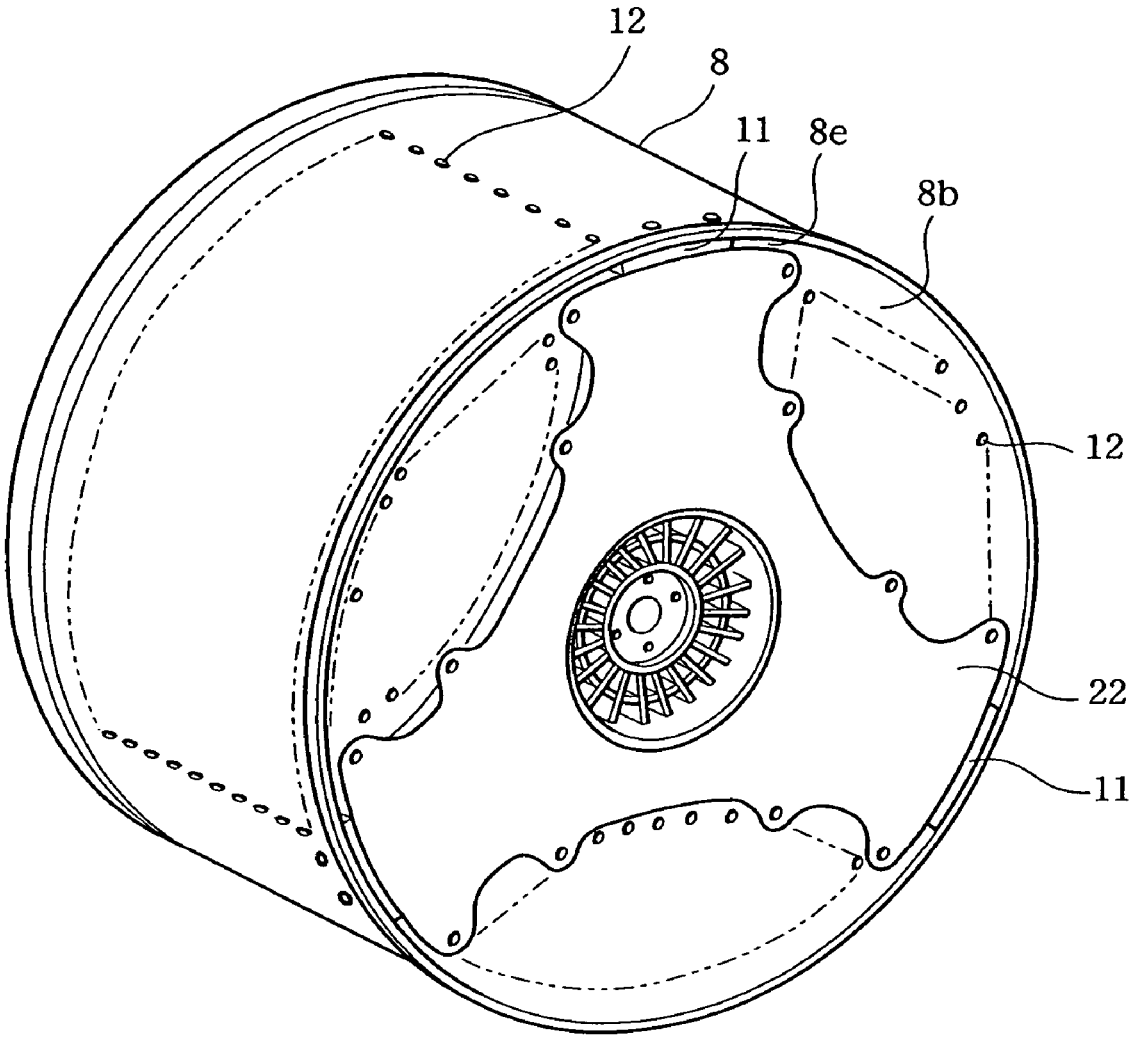
FIG. 6 is a view similar to FIG. 4, showing the drum employed in the drum type washer-drier in accordance with a second form of the disclosure.

FIG. 6 illustrates a second embodiment of the invention. In the second embodiment, similar or identical parts are labeled by the same reference symbols as those in the first embodiment. As shown in FIG. 6, the rectifying cover 22 in the second embodiment is sized so that portions of the outer periphery of the recess 8 are exposed. More specifically, the rectifying cover 22 is formed so that a radial dimension thereof is slightly shorter that that of the end plate 8*b*. When the rectifying cover 22 is mounted on the end plate 8*b*, gaps 8*e* are defined between the outer periphery of the recess 8*c* and the rectifying cover 22. The other construction of the washer-drier of the second embodiment is substantially the same as in the first embodiment.

According to the second embodiment, the gaps 8*e* located at the outer peripheral side of the end plate 8*b* serve as drain holes. Consequently, water remaining between the recess 8*c* and the rectifying cover 22 can reliably be discharged.

Figure 7:
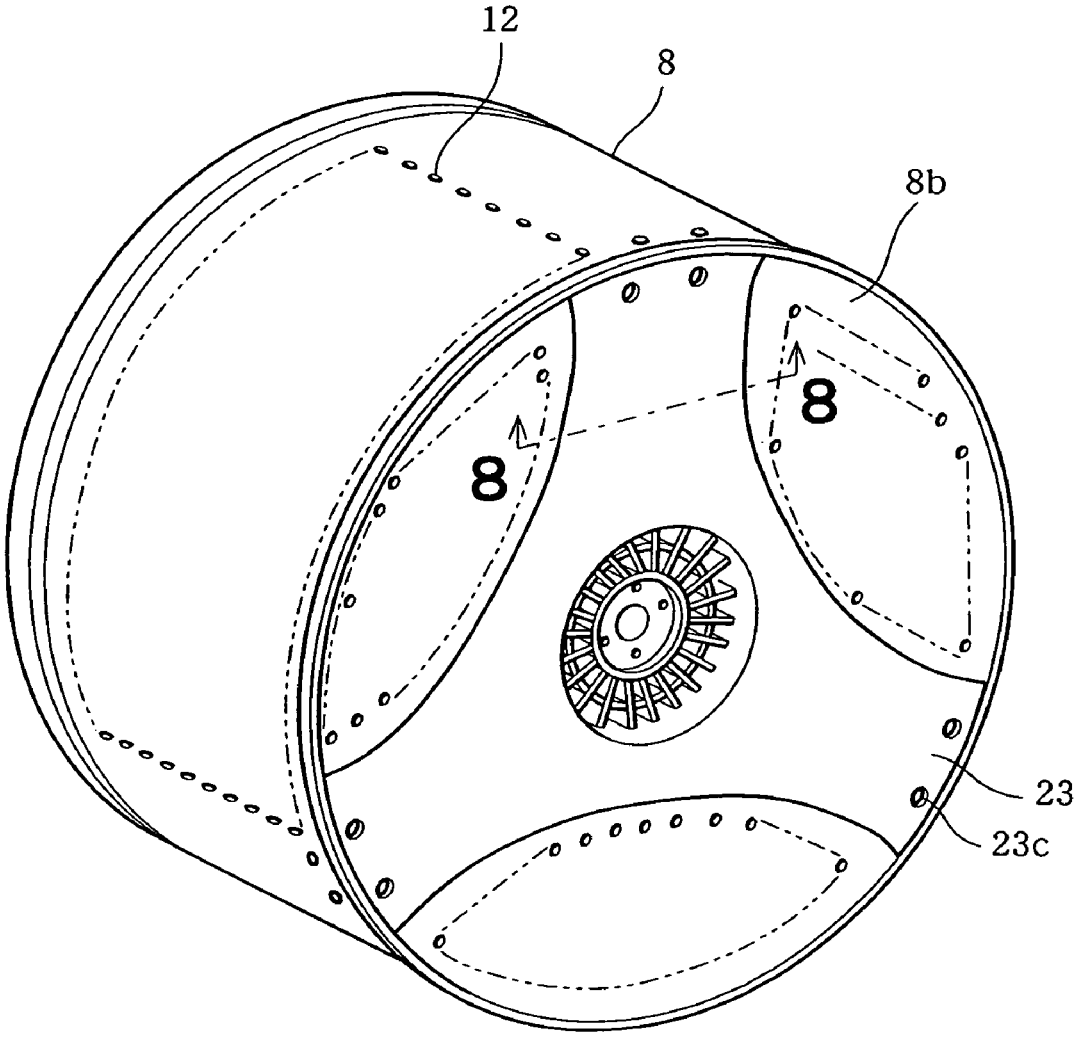
FIG. 7 is a view similar to FIG. 4, showing the drum employed in the drum type washer-drier in accordance with a third form of the disclosure.
Figure 8:
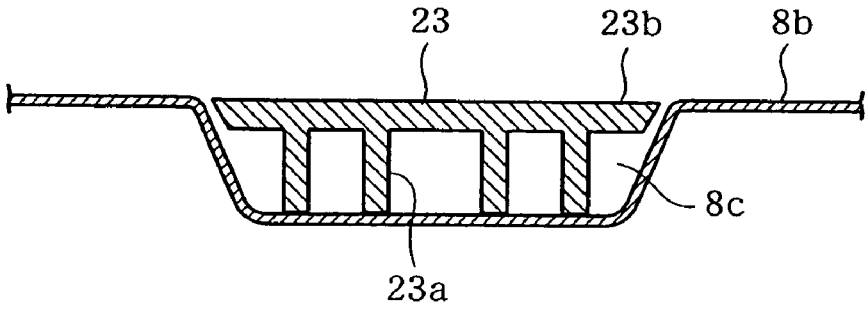
FIG. 8 is a view taken along line 8-8 in FIG. 7.
Figure 9:
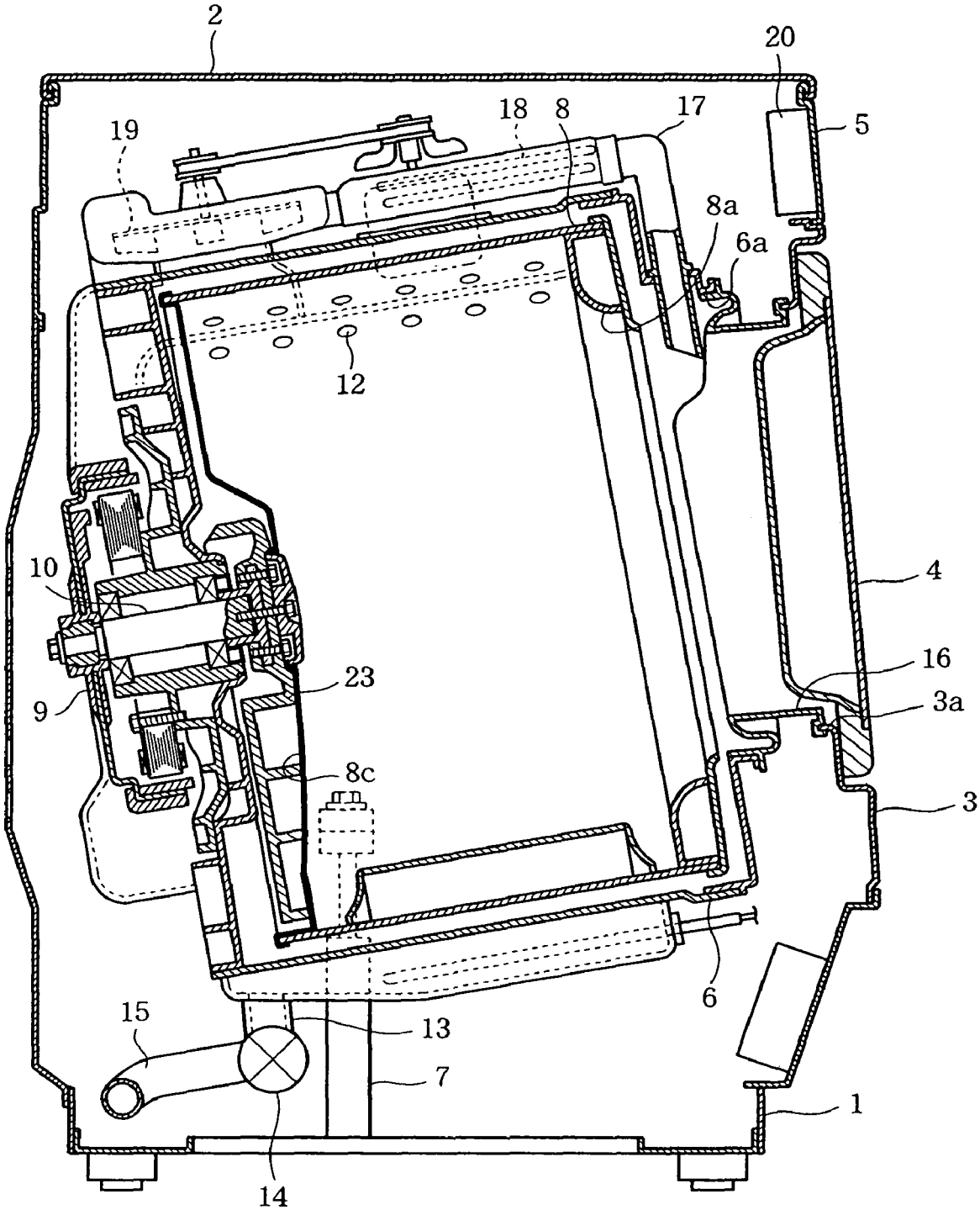
FIG. 9 is a view similar to FIG. 2.

FIGS. 7 to 9 illustrate a third embodiment of the invention. In the third embodiment, similar or identical parts are labeled by the same reference symbols as those in the first embodiment. Referring to FIG. 8, the drum support 23 has an inner surface facing the bottom of the recess 8*c*. The inner surface of the drum support 23 is formed with reinforcing ribs (a reinforcing corrugated portion). The drum support 23 further has an outer surface which is a side opposite the side thereof facing the bottom of the recess 8*c*. The outer surface of the drum support is substantially planar.

The drum support 23 has a flange 23*b* (see FIG. 8) formed on the outer periphery thereof so as to close the opening of the recess 8*c*. The protrusions 23*b* of the drum support 23 have respective distal ends (or portions located at the outer peripheral side of the drum 8) formed with holes 23*c*.

In the above-described construction, the drum support 23 is mounted on the drum 8 so that the ribs 23*a* face the end plate 8*b* side (the bottom of the recess 8*c*) as shown in FIG. 9. As a result, the opening of the recess 8*c* is closed by the drum support 23 and the flange 23*b* of the drum support 23. The other construction of the washer-drier of the second embodiment is substantially the same as in the first embodiment.

In the third embodiment, the drum support 23 is disposed in the recess 8*c* of the drum 8 so that the reinforcing ribs 23*a* of the drum support are face the end plate 8*b* side and so that the end plate 8*b* and the drum support 23 are substantially coplanar. Accordingly, rotational resistance can be reduced when the drum 8 is rotated at high speeds in the dehydration step, whereupon noise can be reduced. Since the rectifying cover 21 employed in the first embodiment is eliminated particularly in the third embodiment, the number of components can be reduced and accordingly, a cost reduction can be achieved.

Furthermore, further noise reduction and further power consumption can be achieved since the flange 23*b* is provided on the drum support 23 so as to close the opening of the recess 8*c*.

The flange 23*b* may or may not be provided although the drum support 23 is provided with the flange 23*b* in the third embodiment.

The invention should not be limited to the embodiments described above with reference to the accompanying drawings. The embodiments may be modified or expanded as follows. In the first embodiment, the recess 8*c* is formed in the end plate 8*b* of the drum 8. The drum support 11 is accommodated in the recess 8*c*. The drum support 11 is then mounted on the drum 8. However, the drum support 11 may be mounted on the drum 8 without provision of the recess 8*c* in the end plate 8*b*. In this case, a rectifying cover may be mounted on the drum 8 and preferably has such a circular plate shape as to cover the entire end plate 8*b* or has substantially the same size as the end plate 8*b*.

Figure 10:
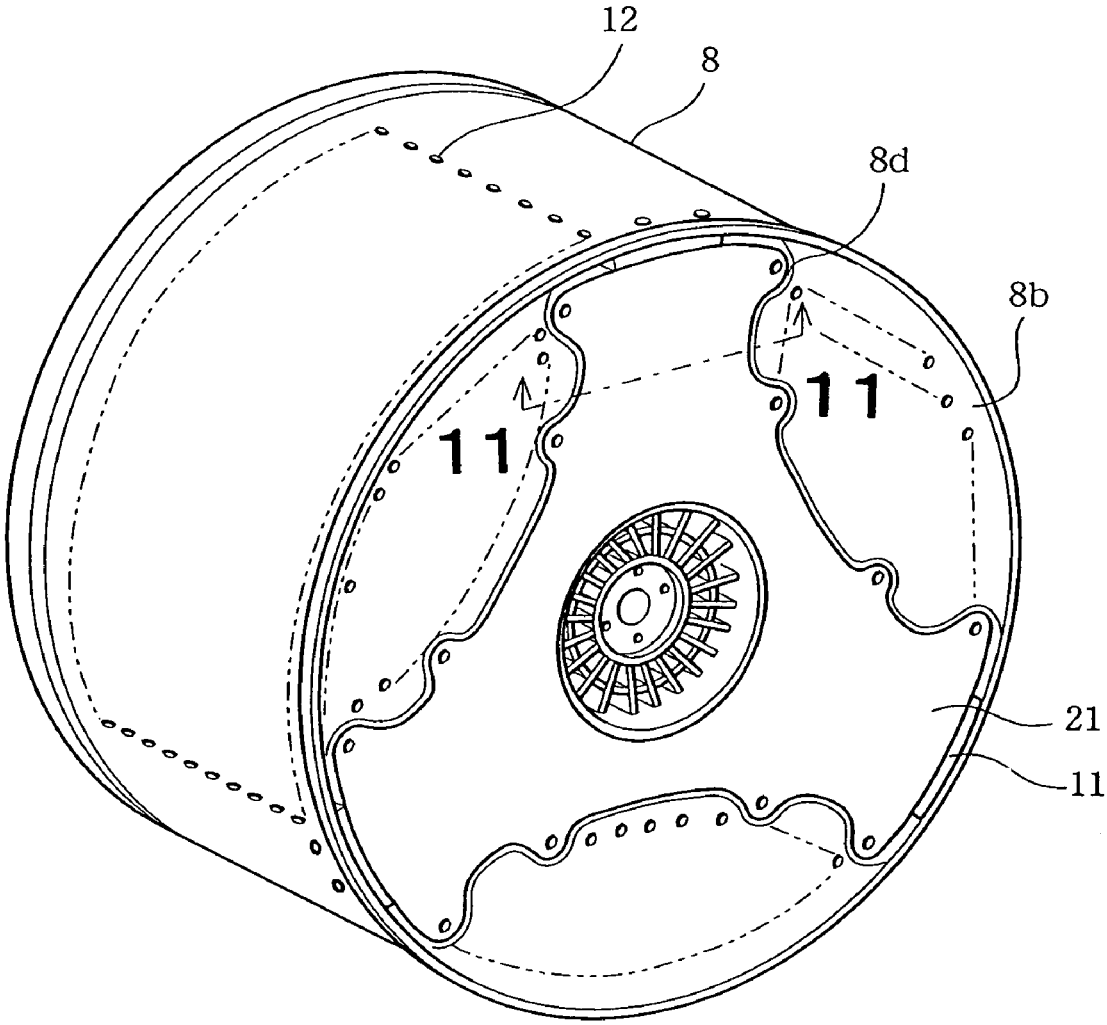
FIG. 10 is a view similar to FIG. 4, showing a modified form.
Figure 11:
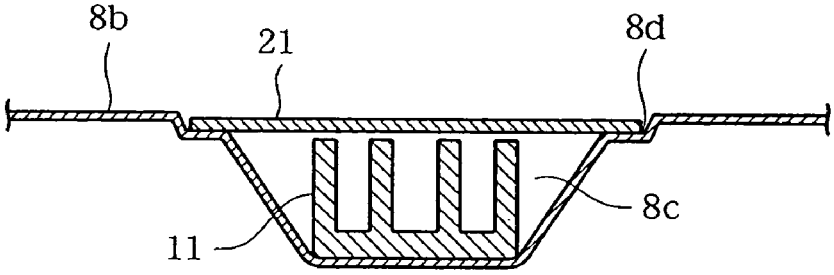
FIG. 11 is a view taken along line 11-11 in FIG. 10.

Furthermore, as shown in FIGS. 10 and 11, the recess 8*c* of the drum 8 has an opening edge formed with a stepped portion 8*d* which has substantially the same thickness as the rectifying cover 21. The rectifying cover 21 may be fitted with the stepped portion 8*d*. In this case, the rectifying cover 21 is preferably recessed slightly relative to the face of the end plate 8*b*. As the result of the aforesaid construction, the difference corresponding to the thickness of the rectifying cover 21 is resolved and the rectifying cover 21 is slightly recessed. Consequently, since resistance of wind against the end face of the rectifying cover 21 can further be reduced during high speed rotation of the drum 8, noise can further be reduced and power consumption can further be reduced. Additionally, a packing may be provided on the end face on which the stepped portion 8*d* is in contact with the rectifying cover 21.

Figure 12:
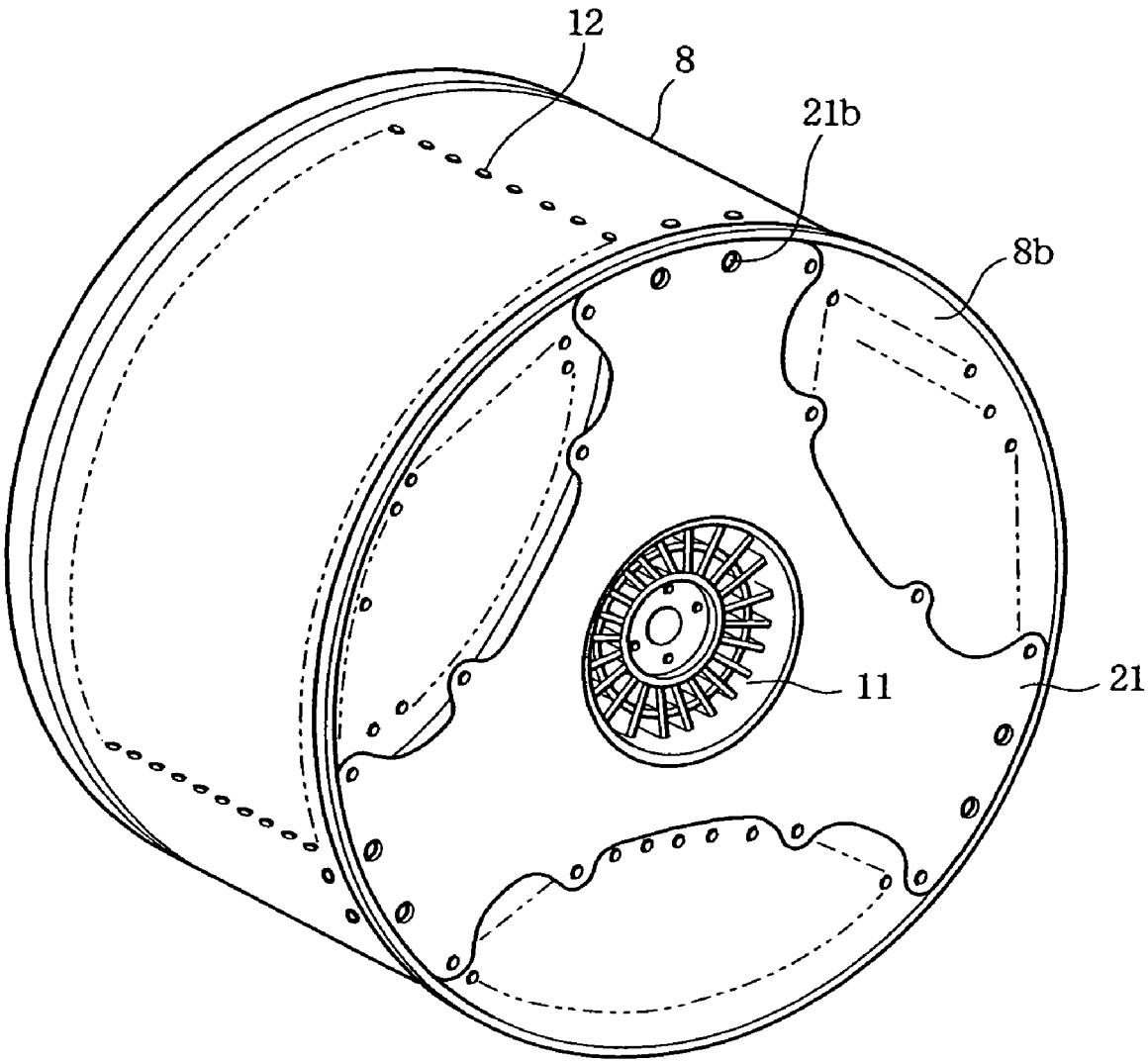
FIG. 12 is a view similar to FIG. 7, showing another modified form.
Figure 13:
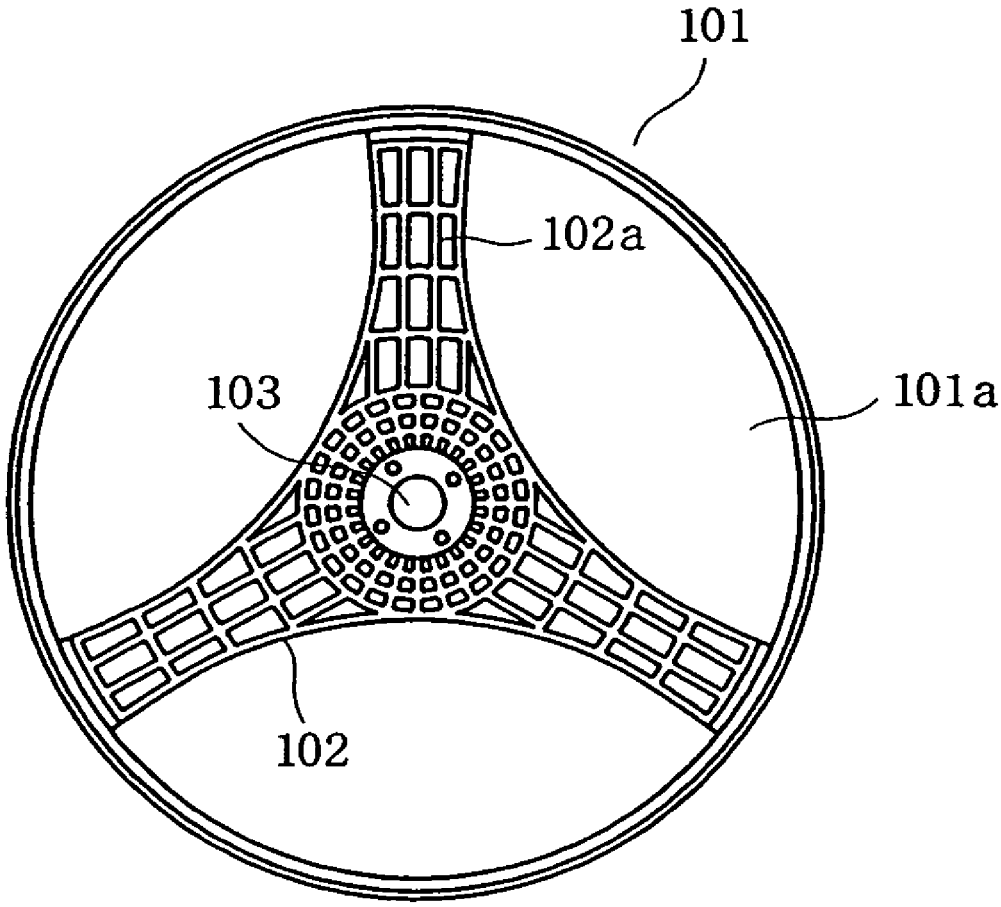
FIG.13 PRIOR ART
FIG. 13 is a rear view of a conventional drum type washing machine.

Furthermore, the gaps 8*e* are defined between the outer periphery of the recess 8*c* and the rectifying cover 22. However, as shown in FIG. 12, drain holes 21*b* may be formed in distal ends of the protrusions 21*b* (near the outer periphery of the drum 8). Each drain hole 21*b* may take any shape even if water is allowed to pass therethrough. For example, each drain hole 21*b* may be a notch.

The invention is applied to the drum washer-dryer of the front loading type in each of the foregoing embodiments. However, the invention may be applied to a drum washer-drier of the top loading type.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A drum type washing machine comprising:

a water tub;

a drum mounted in the water tub so as to be rotatable so that a wash operation and a dehydration operation are carried out, the drum including an end plate having a recess with a bottom; and a drum support enclosed in the recess of the end plate of the drum and including a mount portion on which a shaft supporting the drum is mounted, wherein the drum support has a first side facing the bottom of the recess and provided with a reinforcing corrugated portion; and wherein the drum support has a second side opposed to the first side and substantially planar, the second side and an outer surface of the end plate being substantially coplanar, and wherein the recess has an open end and the drum support includes a flange closing substantially the entire open end of the recess, the flange having a function of reducing noise produced during a high-speed rotation of the drum.

2. The drum type washing machine according to claim 1, wherein the drum support includes a central portion to which the shaft is connected and a plurality of protrusions extending radially from the central portion at regular intervals.

3. The drum type washing machine according to claim 1, wherein the flange is located on an outer periphery of the drum support.

* * * * *